United States Patent [19]

Fredriksson et al.

[11] Patent Number: 4,783,014

[45] Date of Patent: Nov. 8, 1988

[54] DISK REFINER HAVING SLIDING RIGID MULTIPLE DISKS

[75] Inventors: Borje Fredriksson, Dalton; Philip H. Goldenberg, Pittsfield, both of Mass.

[73] Assignee: Beloit Corporation, Beloit, Wis.

[21] Appl. No.: 833,355

[22] PCT Filed: Feb. 25, 1986

[86] PCT No.: PCT/US86/00394

§ 371 Date: Feb. 25, 1986

§ 102(e) Date: Feb. 25, 1986

[87] PCT Pub. No.: WO87/05061

PCT Pub. Date: Aug. 27, 1987

[51] Int. Cl.[4] ..... B02C 7/14

[52] U.S. Cl. ..... 241/261.2; 241/290; 241/297

[58] Field of Search ..... 241/261.2, 28, 261.3, 241/162, 285 R, 161, 285 A, 163, 296, 297, 298, 37, 259.1, 259.2, 259.3, 290

[56] References Cited

U.S. PATENT DOCUMENTS

| | | | |
|---|---|---|---|
| 1,991,899 | 2/1935 | Holbeck | 241/163 X |
| 2,661,667 | 12/1953 | Knoll | 241/163 |
| 3,448,934 | 6/1969 | Vaughan | 241/290 X |
| 3,717,309 | 2/1973 | Luker et al. | 241/296 X |
| 4,570,862 | 2/1986 | Kirchner | 241/261.2 X |

*Primary Examiner*—Mark Rosenbaum

*Attorney, Agent, or Firm*—Dirk J. Veneman; Raymond W. Campbell

[57] ABSTRACT

A paper stock refiner provides low intensity treatment of pulp fiber to increase the strength characteristics of the pulp while reducing the specific energy required through increasing the number of refining surfaces. The number of refining surfaces is accomplished by providing a plurality of rotatable (30) and non-rotatable (36) refiner disks which are axially movable within a refiner, the rotatable disks being mounted on a torque transmitting section (28) of a shaft (26) and the non-rotatable disks being mounted against rotation on a plurality of supporting elements (44). In order to control the number of refiner bar crossings, the housing (12) may be opened and a desired number of refiner disks, both rotating and non-rotating, may be loaded into the refining chamber (16) on the shaft and the support elements, respectively.

14 Claims, 3 Drawing Sheets

FIG.5
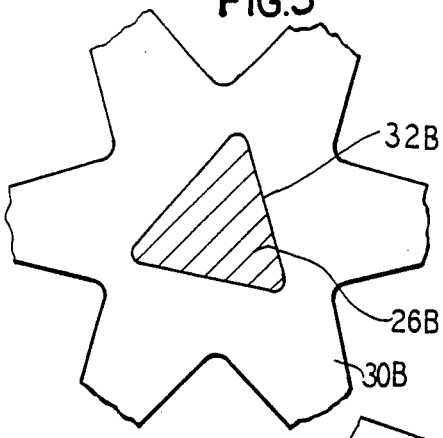
FIG.4
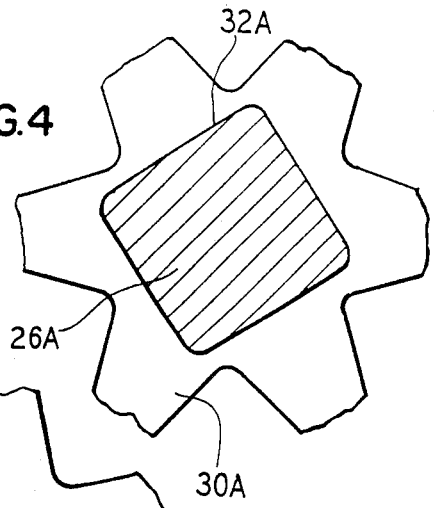
FIG. 6
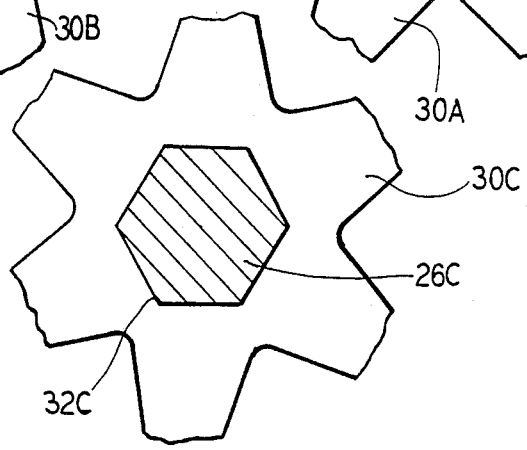
FIG.8
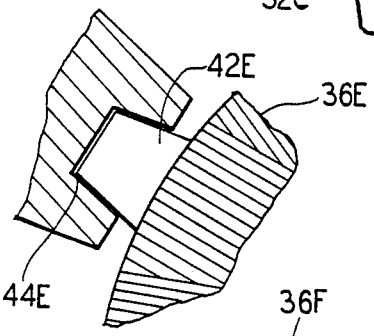
FIG.7
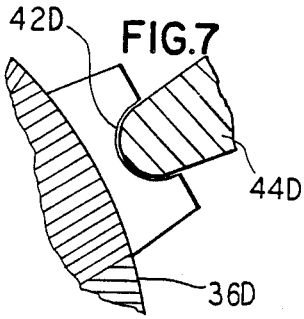
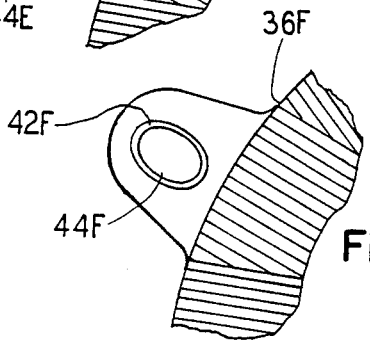
FIG.9

DISK REFINER HAVING SLIDING RIGID MULTIPLE DISKS

The present invention relates to disk refiners, and more particularly to disk refiners for providing a low intensity treatment of pulp fiber to increase the strength characteristics of the pulp and reduce the amount of specific energy required during refining.

It has recently been shown that low intensity treatment of certain pulp fiber increases the strength of characteristics of the pulp while reducing the amount of specific energy required. In this context, intensity for a given throughput is proportional to the horsepower per inch of refiner bar crossings, as disclosed in U.S. Pat. No. 4,661,911 filed Jan. 31, 1985, in which specific operational parameters of a refining system are sensed to control the refiner disk spacing by way of a gearmotor. A reduction in intensity, therefore, may be accomplished by increasing the number of refining surfaces in a given refiner.

It is the object of the present invention to provide a new and improved multi-disk refiner for low intensity treatment of pulp fiber.

The above object is achieved, according to the present invention, in providing an increase in the number of refining surfaces by mounting several rigid refiner disks in a manner so as to provide each disk with complete freedom of axial movement. The rotating refiner disks can be mounted so as to be axially slidable on a torque transmitting section of a shaft so that rotational forces can be transmitted to the disks while an axial motion thereof is not restrained. The torque transmitting section of the shaft may be splined or have a geometrical cross-sectional (e.g. square, triangular or other polygon) and the rotatable disks may have correspondingly shaped central openings receiving the respective torque transmitting section. Non-rotatable or fixed refiner disks can be supported by several support lemens (e.g. pins, guide rails and the like) which prevent rotation of the disk, but permit each such refiner disk to slide in the axial direction. The shaft and the stator support elements can be constructed of a hard material, and the sliding members may be constructed of softer, wearable material. The sliding members may also be molded from a structural plastic material. The non-rotating disks each include a central aperture for receiving the shaft therethrough and for supporting the flow of paper stock and the rotating disks each include ports to permit the paper stock to flow therethrough and be properly distributed to each pair of refiner disks.

The refiner may be loaded to the desired power by axially adjusting the last stationary element of a series of refiner disks.

Inasmuch as the refiner disks are not axially secured to the refiner shaft or housing, the number of plates may easily be increased or decreased in the refiner to match the process requirements.

Also, inasmuch as there is no limitation on the axial movement of the refiner disks, a large number of plates may be added to a refiner to increase the overall capacity of a given size of the refiner. Therefore, a smaller diameter refiner having many refiner discs may be used in place of a large refiner having fewer discs. This reduces the capital expense for large horsepower, low speed motors which are required by the larger diameter refiners.

Other objects, features and advantages of the invention, its organization, construction and operation will be best understood from the following detailed description, taken in conjunction with the accompanying drawings.

ON THE DRAWINGS

FIG. 4 is a fragmentary sectional view illustrating a shaft having a square torque transmitting section;

FIG. 5 is a fragmentary sectional view illustrating a shaft having a triangular torque transmitting section;

FIG. 6 is a fragmentary sectional view illustrating a shaft having a hexagonal torque transmitting section;

FIG. 7 is a fragmentary sectional view illustrating an arcuate guide rail support structure;

FIG. 8 is a fragmentary sectional view illustrating a trapezoidal guide rail support structure; and FIG. 9 is a fragmentary sectional view illustrating an oval support element structure.

Figure 1:
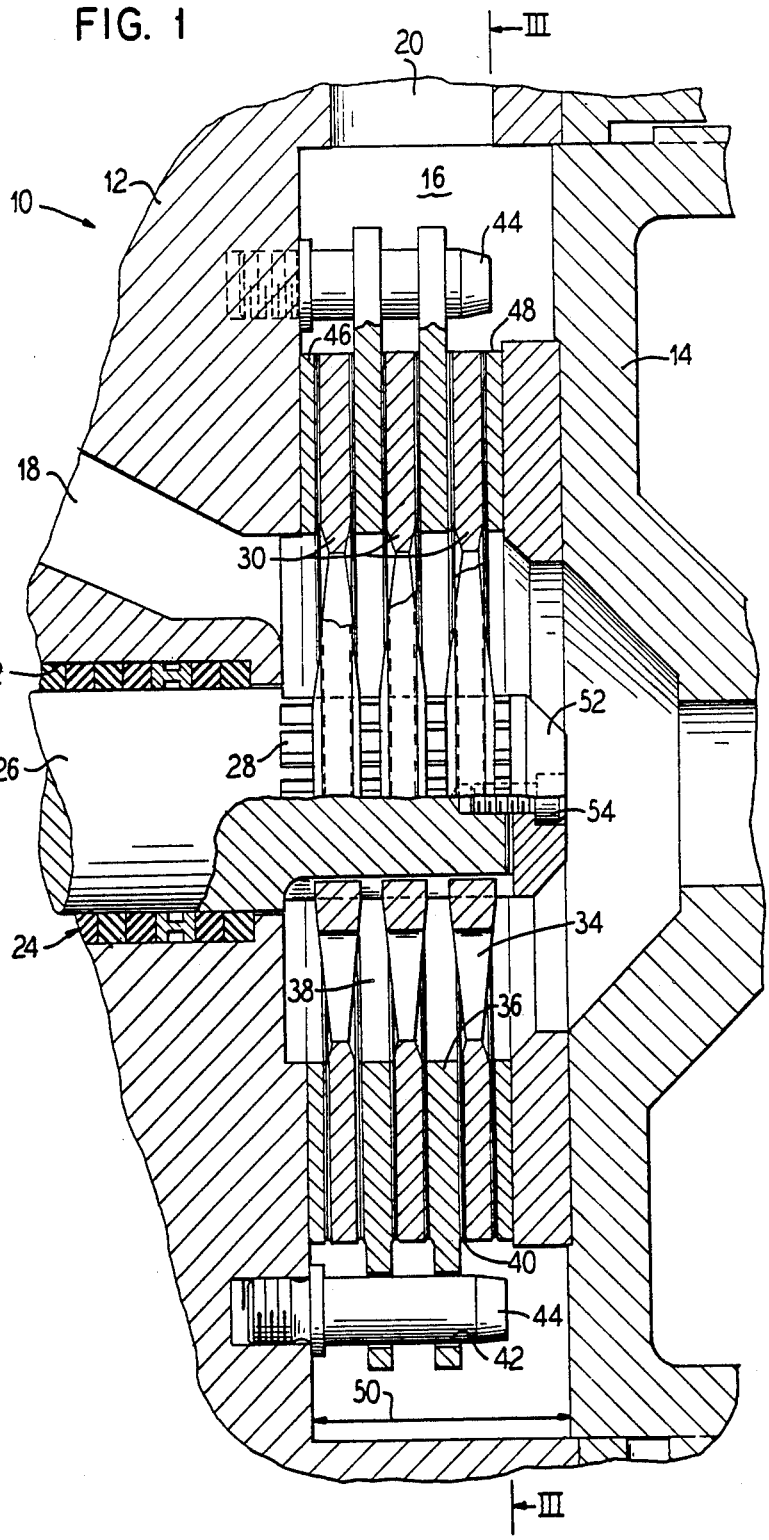
FIG. 1 is a fragmentary sectional view of a refiner constructed in accordance with the present invention.

Referring to the drawings, a refiner, constructed in accordance with the present invention, is generally illustrated at 10 as comprising a first housing part 12 having a recess therein which, with a second housing part 14 defines a refining chamber 16. The refiner comprising a paper stock flow path incoluding a paper stock input 18 to the refining chamber 16 and a paper stock output 20 from the refining chamber 16.

The housing part 12 comprises a bore 22 with a bearing 24 therein supporting a shaft 26 for rotation. The shaft 26 includes a splined section 28 for mounting a plurality of rotatable refiner discs 30 each of which has a central aperture 32 complemental to the spline 28.

As seen in each of the figures, each rotatable disc 30 comprises a plurality of ports 34 for supporting a flow of stock.

Alternately mounted with the rotatable disc 30 is a plurality of refiner discs 36 each of which is provided with a central aperture 38 for receiving the shaft therethrough and for supporting a flow of paper stock. Each of the plates 36 further comprises a plurality of bores 42 for receiving a respective pin 44 mounted to the housing part 12.

Each of the rotatable refiner discs 30 is axially slidable along the spline section 28 of the shaft 26. By the same token, each of the non-rotatable refiner discs is axially slidable on the pins 44.

Each of the refiner discs 30 and 36 and each of a pair of end discs 46 and 48 respectively mounted to the housing parts 12 and 14, comprise refiner bars which accomplish the actual refining operation.

As previously mentioned, the refiner may be loaded with the desired power by axially adjusting the last stationary element, in this case the element 46 or the element 48. This may be accomplished by screw techniques, or by a gear motor or the like and essentially adjust the relative spacing of the housing parts 12 and 14, as indicated by the double-headed arrow 50.

As shown in FIG. 1, the splined shaft may be provided with an end cap 52 secured to the distal end of the shaft by way of at least one screw 54 which may be employed to maintain the rotatable refiner disc on the shaft prior to assembly of the left and right-hand sides of the housing parts illustrated in FIG. 1. After assembly, of course, the axial movement of the refiner discs are limited by the fixed refiner disc 46 and 48.

As mentioned above, and stated in slightly different terms, a desirable goal achieved by the present invention is to essentially match a given size refiner to the process requirements by providing the refiner with a number of refining discs which will accomplish a low intensity treatment so as to increase the strength characteristics of the pulp and reduce the amount of specific energy required for the refining process.

This may be readily accomplished in practicing the present invention with structure of the type illustrated in FIG. 1 in which the housing parts 12 and 14 are separated from one another and the desired number of refiner discs 30 and 36 are mounted, respectively, on the splined shaft 26,28 and on the support pins 44.

As mentioned above, the torque transmitting section of the shaft may comprise various cross-sectional shapes. Examples of these are illustrated in FIGS. 4–6.

Referring to FIG. 4, a refiner disk 30A includes a square central aperture 32A for receiving a square torque transmitting section 26A of the shaft.

In FIG. 5, a disk 36B includes a central aperture 32B in the form of a triangle for receiving a triangular section 26B of a shaft.

In FIG. 6, the disk 36C includes a hexagonal central opening 32C for receiving a hexagonal section 26C of a shaft.

The above torque transmitting constructions, of course, are not the only constructions which may be employed in practicing the invention.

Figure 2:
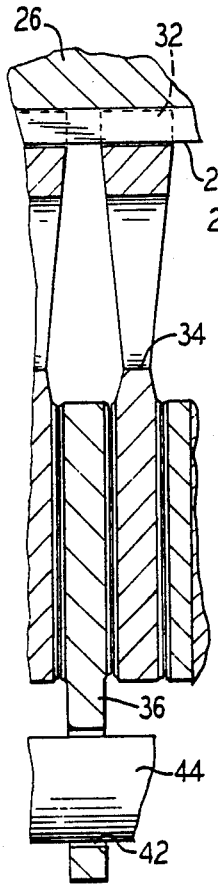
FIG. 2 is a fragmentary enlarged view of a portion of the refiner illustrated in FIG. 1.
Figure 3:
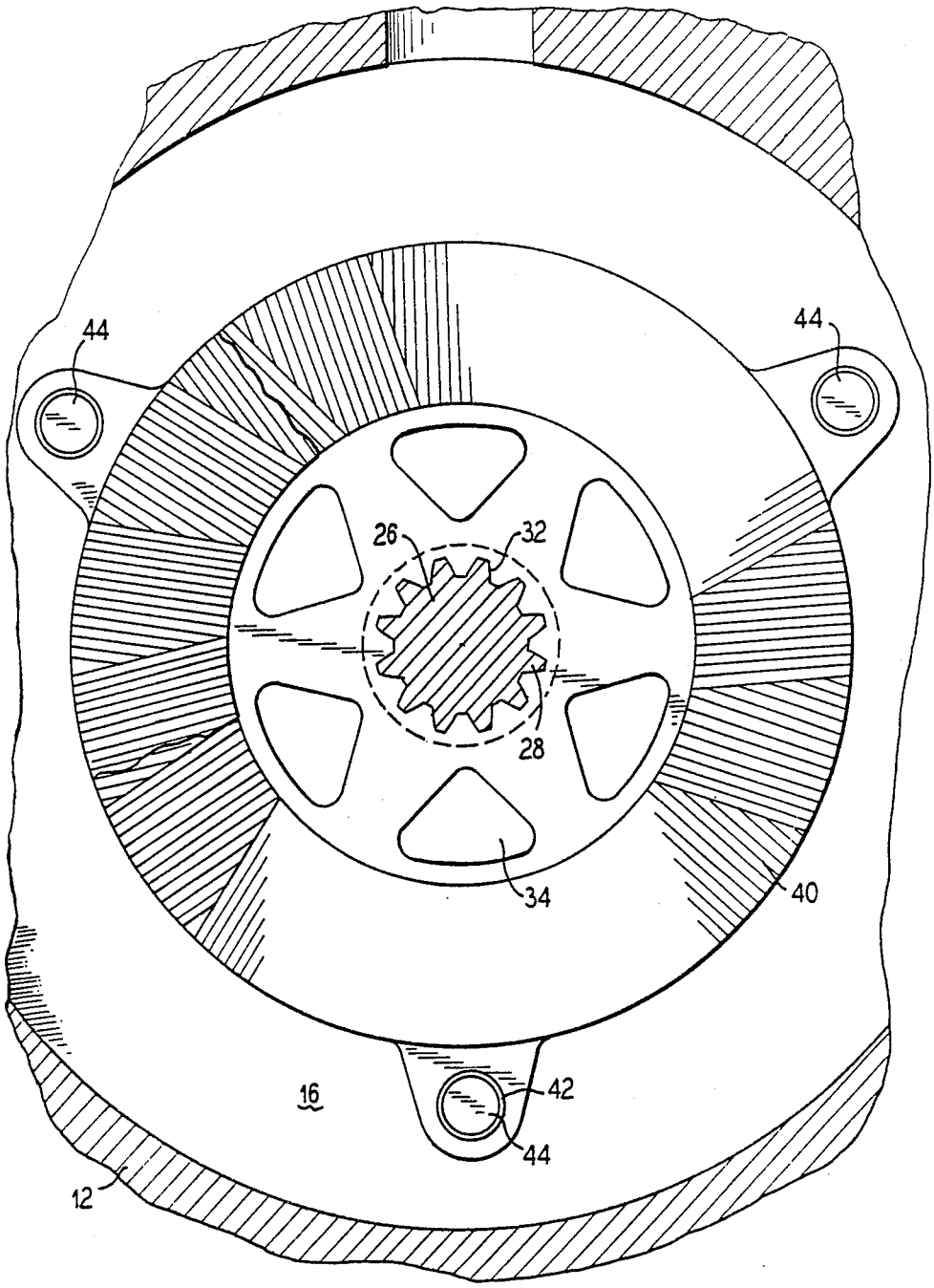
FIG. 3 is a partial sectional view taken substantially along the parting line III—III of FIG. 1.

By the same token, the support pins 44 of FIGS. 1–3 may be replaced by other structures. Examples of such structures are illustrated in FIGS. 7–9.

Referring to FIG. 7, a disk 36D includes a projection having an arcuate groove 42D for slidingly receiving a complemental arcuate projection 44D which is secured to the refiner housing.

In a similar, but somewhat reverse manner, FIG. 8 illustrates a disk 36E carrying a trapezoidal projection 42E to be slidingly received in a complemental groove 44E extending from the wall of the refiner housing.

In somewhat the same manner as in FIGS. 1–3, FIG. 9 illustrates the use of an oval support pin 44F to be slidingly received in an oval aperture 42F provided on an extension of the refiner disk 36F.

Although we have described our invention by reference to particular illustrative embodiments thereof, many other changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

What is claimed is:

1. In a disk refiner of the type in which a plurality of first refiner disks and a plurality of second refiner disks are alternately mounted in a refining chamber within a refiner housing and each including refiner bars, the first refiner disks being mounted against rotation and the second refiner disks mounted on a rotatable shaft, the chamber located in a pulp fiber flow path, the improvement therein for lowering the intensity treatment and increasing the strength characteristics of the pulp, in combination therewith, comprising: first mounting means mounting said first refiner disks for axial movement, comprising a plurality of support elements extending from the housing into the refining chamber, a plurality of holes through each of said first refiner disks slidingly receiving respective ones of said support elements for unrestricted axial movement thereon within a limited axial distance along said support elements in response to internal refiner pressure and a central flow opening in each of said first refiner discs receiving the rotatable shaft therethrough; second mounting means mounting said second refiner disks alternately with said first refiner disks, for rotation and for unrestricted axial movement, comprising a shaped torque transmitting section on the shaft, a central opening in each of said second refiner disks slidingly receiving said torque transmitting section therethrough for rotation with and axial movement on said shaft within a limited axial distance along said shaft responsive to internal refiner pressures, and flow ports through each of said second refiner disks for supporting a distribution of the paper stock to the refiner bars; and loading means for controlling axial distance in which axial movement of said disks can occur along said support elements and said shaft.

2. A disk refiner comprising: a housing including a first housing part, a second housing part connected to said first housing part, chamber means defining a refining chamber, a paper stock passageway through said housing including said refining chamber, and a plurality of support elements extending from one of said housing parts into said refining chamber; a shaft rotatably mounted in said first housing part and including a shaped section extending into said refining chamber; a plurality of stator refining disks and a plurality of rotor refining disks, each of said refining disks comprising refiner bar crossings, each of said stator disks including a central opening receiving said shaped section of said shaft therethrough and a plurality of bores for receiving and being freely axially movable on said support elements in response to internal refiner pressures, said rotor disks disposed alternately with said stator disks and each including a shaped central opening complemental to and slidingly receiving said shaped section of said shaft therethrough for rotation with and free axial movement on said shaft in response to internal refiner pressures.

3. A disk refiner comprising: a housing including a first housing part, a second housing part connected to said first housing part, chamber means defining a refining chamber, a paper stock passageway through said housing including said refining chamber, and a plurality of support elements extending from one of said housing parts into said refining chamber; a shaft rotatably mounted in said first housing part and including a shaped torque transmitting section extending into said refining chamber; a plurality of stator refining disks and a plurality of rotor disks, each of said refining disks comprising refiner bar crossings, each of said stator disks including a central opening receiving said shaped torque transmitting section of said shaft therethrough and a plurality of bores for receiving and being freely axially movable on said support elements in response to internal refiner pressure, said rotor disks disposed alternately with said stator disks and each including a shaped central opening complemental to and slidingly receiving said shaped torque transmitting section of said shaft therethrough for rotation with and free axial movement on said shaft in response to internal refiner pressure; and means for releasably connecting said first and second housing parts for changing the number of said plurality of stator plates and rotor plates.

4. A disk refiner comprising: a housing including a first housing part, a second housing part connected to said first housing part, chamber means defining a refining chamber, a paper stock passageway through said housing including said refining chamber, and a plurality of support members extending from said housing into said refining chamber; a shaft rotatably mounted in said first housing part and including a torque transmitting section extending into said refining chamber; a plurality of stator refining disks and a plurality of rotor refining disks, each of said refining disks comprising refiner bar crossings, each of said stator disks including a central opening receiving said torque transmitting section of said shaft therethrough and a plurality of anti-rotation elements received by and freely axially movable on said support members in response to internal refiner pressures, said rotor disks disposed alternately with said stator disks and each including a shaped central opening complemental to and slidingly receiving said torque transmitting section of said shaft therethrough for rotation with and free axial movement on said shaft in response to internal refiner pressure.

5. The disk refiner of claim 4, wherein: said torque transmitting section comprises a non-circular cross section.

6. The disk refiner of claim 4, wherein: said torque transmitting section comprises a square cross section.

7. The disk refiner of claim 4, wherein: said torque transmitting section comprises a triangular cross section.

8. The disk refiner of claim 4, wherein: said torque transmitting section comprises a polygonal cross section.

9. The disk refiner of claim 4, wherein: each of said support elements comprises an elongate groove; and each of said anti-rotation elements comprises a projection on the respective disk slidably received in the respective groove.

10. The disk refiner of claim 9, wherein: each of said elongate grooves has an arcuate cross-section; and each of said anti-rotation elements comprises an arcuate cross-section.

11. The disk refiner of claim 9, wherein: each of said elongate grooves has a trapezoidal cross-section; and each of said anti-rotation elements comprises a trapezoidal cross section.

12. The disk refiner of claim 4, wherein: each of said support elements comprises a circular cross-section; and each of said anti-rotation elements comprises a circular cross section.

13. The disk refiner of claim 4, wherein: each of said support elements comprises an oval cross-section; and each of said anti-rotation elements comprises an oval cross-section.

14. A disk refiner comprising: a housing including a first housing part, a second housing part connected to said first housing part, chamber means defining a refining chamber, a paper stock passageway through said housing including said refining chamber, and a plurality of shaped support elements extending from one of said housing parts into said refining chamber; a shaft rotatably mounted in said first housing part and including a shaped section extending into said refining chamber; a plurality of stator refining disks and a plurality of rotor disks, each of said refining disks comprising refiner bar crossings, each of said stator disks including a central opening complemental to and receiving said shaped section of said shaft therethrough and a plurality of shaped bores complemental to and receiving and being freely axially movable on said support elements in response to internal refiner pressure, said rotor disks disposed alternately with said stator disks and each including a shaped central opening complemental to and slidingly receiving said shaped section of said shaft therethrough for rotation with and free axial movement on said shaft in response to internal refiner pressure; and means for releasably connecting said first and second housing parts for changing the numbers of said plurality of stator plates and rotor plates.

* * * * *